United States Patent [19]

Chang

[11] Patent Number: 4,823,943

[45] Date of Patent: Apr. 25, 1989

[54] EYEGLASSES CASE OR CONTACT LENS CASE COVER

[75] Inventor: Haehie Chang, Washington, D.C.

[73] Assignee: Non Nu, Inc., Alexandria, Va.

[21] Appl. No.: 118,044

[22] Filed: Nov. 9, 1987

[51] Int. Cl.[4] ..... B65D 85/38

[52] U.S. Cl. ..... 206/5; 150/143; 206/818

[58] Field of Search ..... 206/5 R, 5.1, 818; 150/143; 383/42, 98

[56] References Cited

U.S. PATENT DOCUMENTS

| | | | |
|---|---|---|---|
| 421,438 | 2/1890 | Shailer | 206/5 R |
| 636,811 | 11/1899 | Kirstein | 206/5 R |
| 1,177,752 | 4/1916 | Wilson | 206/5 R |
| 1,834,419 | 12/1931 | Pratt | 206/5 R |
| 2,656,912 | 10/1953 | Stegeman | 206/5 R |
| 2,708,025 | 5/1955 | Bartelli | 206/5 R |
| 2,725,914 | 12/1955 | Daum | 206/5 R |
| 2,784,757 | 3/1957 | Bosca et al. | 150/143 |
| 3,051,130 | 8/1962 | Morris | 206/818 |
| 3,749,301 | 7/1973 | Peckar | 206/818 |
| 3,819,033 | 6/1974 | Hueber | 206/5 |

FOREIGN PATENT DOCUMENTS

| | | | |
|---|---|---|---|
| 1529783 | 5/1968 | France | 206/818 |

*Primary Examiner*—Jimmy G. Foster

*Attorney, Agent, or Firm*—Oblon, Fisher, Spivak, McClelland & Maier

[57] ABSTRACT

An eyeglasses case or contact lens case cover having a pouch (10, 34) sized and shaped to receive a pair of eyeglasses (12) or a case (36) for contact lenses for storage; a closure (14, 38) hingedly attached to the pouch (10, 34) and sized, shaped, and positioned so that it can be pivoted away from the pouch (10, 34) to facilitate the insertion or removal of a pair of eyeglasses (12) or a case (36) for contact lenses from the pouch (10, 34) and pivoted into contact with the pouch (10, 34) to protect a pair of eyeglasses (12) or a case (36) for contact lenses contained therewithin; and at least one magnetic fastener (16, 40) including a first member (18, 42) attached to the inside of the pouch (10, 34) and a second member (20, 44) attached to the inside of the closure (14, 38) in position to releasably engage the first member (18, 42) when the closure (14, 38) is pivoted into close proximity to the pouch (10, 34).

4 Claims, 4 Drawing Sheets

EYEGLASSES CASE OR CONTACT LENS CASE COVER

CROSS REFERENCE TO RELATED APPLICATIONS

This application is related to application Ser. No. 118,342, filed 11/9/87, attorney's docket 2446-002-25; application Ser. No. 118,346, filed 11/9/87, attorney's docket 2446-003-25; application Ser. No. 118,347, filed 11/9/87, attorney's docket 2446-004-25; and application Ser. No. 118,345, filed 11/9/87, attorney's docket 2446-006-25.

FIELD OF THE INVENTION

This invention relates to eyeglasses cases or contact lens case covers designed to be carried in a pocket or in a purse or to be carried separately as a purse. In particular, it relates to such cases or covers comprising a pouch sized and shaped to receive and store a pair of eyeglasses or a contact lens case and a closure hingedly attached to the pouch.

BACKGROUND OF THE INVENTION

Eyeglasses cases and contact lens case covers of this general type are well known. However, in such eyeglasses cases and contact lens case covers known to the present inventor, the closure is either snapped into position on the pouch or resiliently biased into position by an internal spring.

SUMMARY OF THE INVENTION

In the eyeglasses case or contact lens case cover according to the present invention, the closure is releasably attached to the pouch by means of at least one magnetic fastener comprising a first magnetic member attached to the inside of the pouch and a second magnetic member attached to the inside of the closure in position to releasably engage the first magnetic member when the closure is pivoted into close proximity to the pouch.

DETAILED DESCRIPTION OF THE PRESENTLY PREFERRED EMBODIMENTS

The First Embodiment

Figure 1:
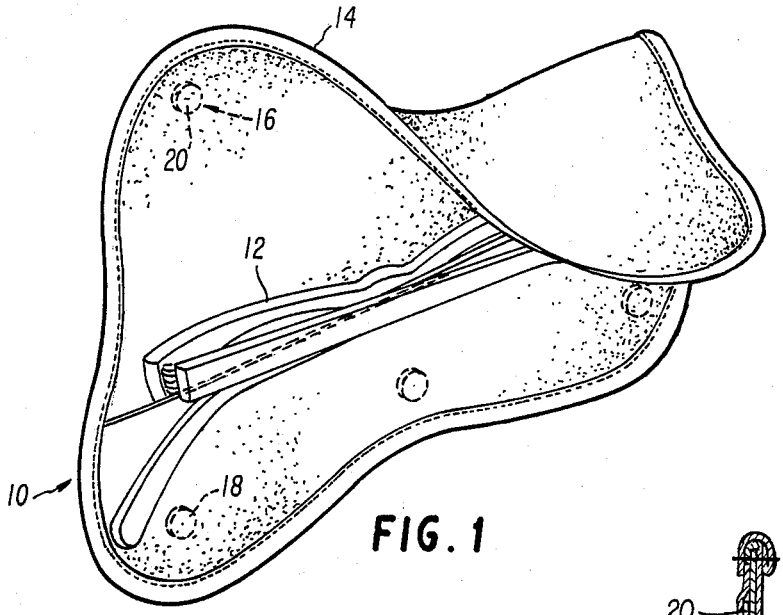
FIG. 1 is a perspective view of an eyeglasses case according to the invention.

The eyeglasses case shown in FIGS. 1–5 comprises a pouch 10 sized and shaped to receive a pair of eyeglasses 12 for storage. A closure 14 is hingedly attached to the pouch 10 and sized, shaped, and positioned so that it can be pivoted away from the pouch 10 to facilitate the insertion or removal of the eyeglasses 12 from the pouch 10 (i.e., it can be pivoted to the open position shown in FIG. 2) and so that it can be pivoted into contact with the pouch 10 to protect the eyeglasses 12 in the pouch 10 (i.e., it can be pivoted to the closed position shown in FIG. 5).

At least one (preferably, three) magnetic fasteners 16 are provided to releasably attach the closure 14 to the pouch 10. Each magnetic fastener 16 comprises a first member 18 attached to the inside of the pouch 10 and a second member 20 attached to the inside of the closure 14 in position to releasably engage the first member 18 when the closure 14 is pivoted into close proximity to the pouch 10. Instead of the individual, button magnetic fasteners 16 shown in the drawings, linear magnetic fasteners (each comprising a pair of strip magnets) can be used.

The pouch 10 and the closure 14 are both preferably made at least in part from a soft, flexible cloth (either woven or non-woven and either natural or synthetic). The pouch 10 and/or the closure 14 can be ornamented, i.a., with fur, rhinestones, pearls, ornamental coral, snake skin, or combinations of the above. Preferably, the pouch 10 is made from two or more pieces sewn together at the edges, and the closure 14 is preferably an extension of one side of the pouch 10.

Figure 4:
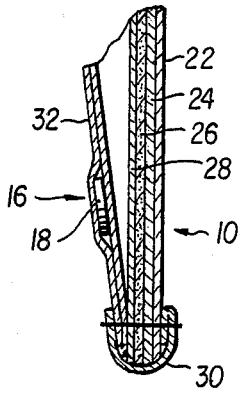
FIG. 4 is a view of the bottom of FIG. 3 on an enlarged scale.
Figure 3:
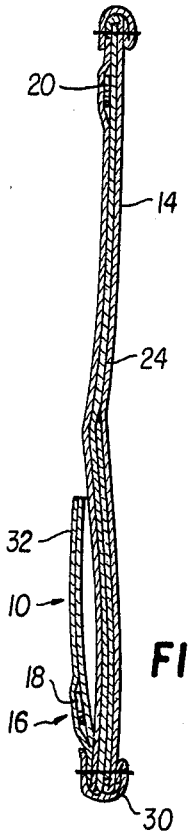
FIG. 3 is a sectional view along the line III—III in FIG. 2.
Figure 5:
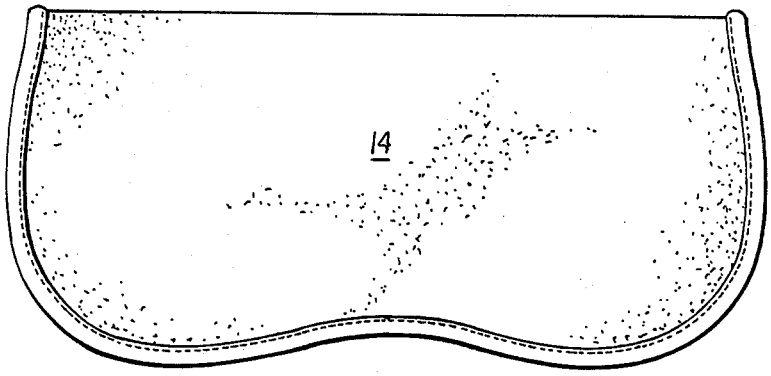
FIG. 5 is a front view of the eyeglasses case shown in FIG. 1 in its closed condition.
Figure 2:
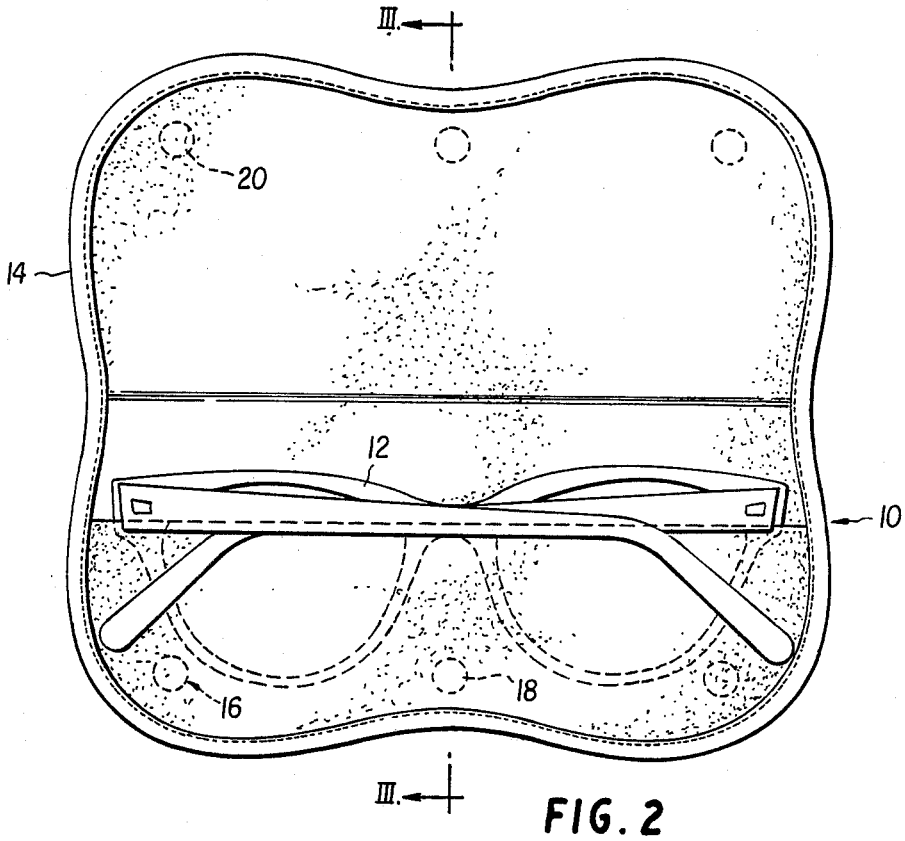
FIG. 2 is a front view of the eyeglasses case shown in FIG. 1 in its open condition.

As best seen in FIG. 4, the piece which forms both the closure 14 and the back of the pouch 10 is preferably made from an outer layer 22 made of cloth, an intermediate stiffening layer 24 (made from plastic, cardboard, or buckram), an intermediate padding layer 26 (made from, e.g., sponge foam), and an inner layer 28 made of cloth (e.g., velvet, Ultrasuede®, or satin). As seen in FIG. 3, the intermediate stiffening layer 24 preferably does not extend into the closure 14. Also, as seen in both FIGS. 3 and 4, the edges of both the pouch 10 and the closure 14 are preferably encased in a separate edging strip 30.

The front of the pouch 10 is preferably formed of a separate piece of cloth 32 which is attached to the back of the pouch 10 by the edging strip 30 as shown in FIG. 4.

The Second Embodiment

Figure 6:
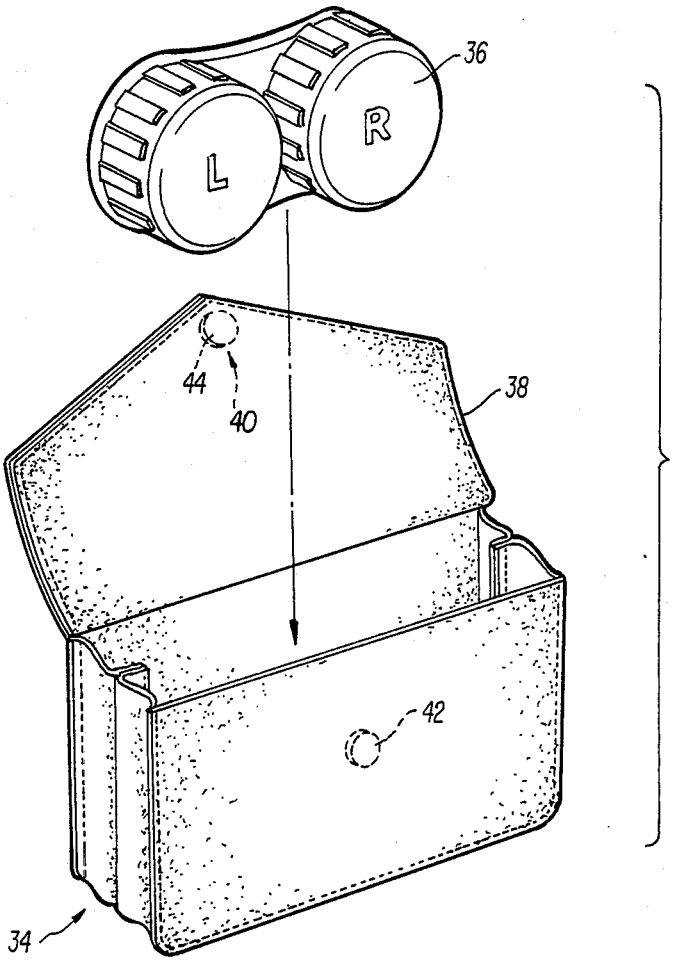
FIG. 6 is a perspective view of a contact lens case cover according to the invention.
Figure 7:
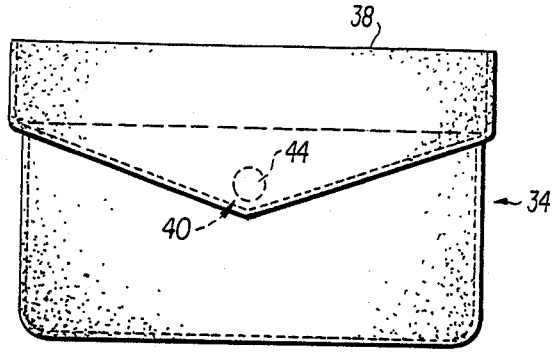
FIG. 7 is a front view of the contact lens case cover shown in FIG. 6 in its closed condition.
Figure 8:
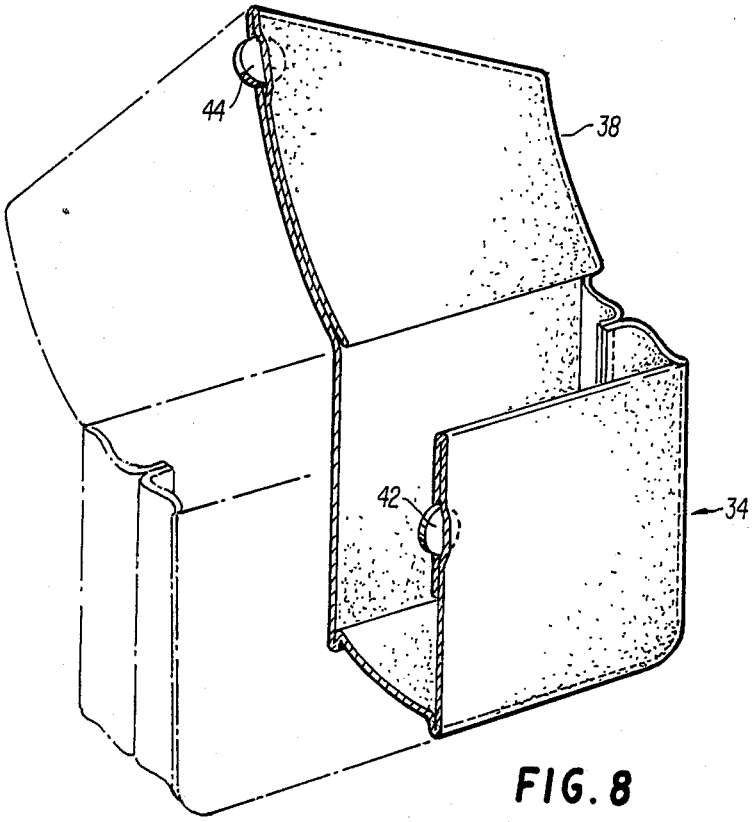
FIG. 8 is a perspective, partly sectional view of the contact lens case cover shown in FIG. 6.

The contact lens case cover shown in FIGS. 6–8 comprises a pouch 34 sized and shaped to receive a case 36 for a pair of contact lenses for storage. A closure 38 is hingedly attached to the pouch 34 and sized, shaped, and positioned so that it can be pivoted away from the pouch 34 to facilitate the insertion or removal of the case 36 from the pouch 34 (i.e., it can be pivoted to the open position shown in FIGS. 6 and 8) and so that it can be pivoted into contact with the pouch 34 to protect the case 36 in the pouch 34 (i.e., it can be pivoted to the closed position shown in FIG. 7).

At least one magnetic fastener 40 is provided to releasably attach the closure 38 to the pouch 34. Each magnetic fastener 40 comprises a first member 42 attached to the inside of the pouch 34 and a second member 44 attached to the inside of the closure 38 in position to releasably engage the first member 42 when the closure 38 is pivoted into close proximity to the pouch 34. Instead of the individual, button magnetic fastener 40 shown in the drawings, linear magnetic fasteners (each comprising a pair of strip magnets) can be used.

The pouch 34 and the closure 38 are both preferably made at least in part from a soft, flexible cloth (either woven or non-woven and either natural or synthetic).

The pouch 34 and/or the closure 38 can be ornamented, i.a., with fur, rhinestones, pearls, ornamental coral, snakeskin, or combinations of the above. Preferably, the pouch 34 and the closure 38 are made from a single piece of cloth.

CAVEAT

While two preferred embodiments of the subject invention have been described in detail, it will be readily appreciated by those of ordinary skill in the art that numerous other embodiments of the invention can be designed. Accordingly, the subject invention must be interpreted with reference to the claims appended hereto and not merely with reference to the preferred embodiments described herein.

What is claimed as new and desired to be secure by Letters Patent of the United States is:

1. An eyeglasses case or contact lens case cover comprising:

(a) a pouch sized and shaped to receive a pair of eyeglasses or a contact lens case for storage;

(b) a closure hingedly attached to said pouch and sized, shaped, and positioned so that it can be pivoted away from said pouch to facilitate the insertion or removal of a pair of eyeglasses or a contact lens case from said pouch and pivoted into contact with said pouch to protect a pair of eyeglasses or a contact lens case contained therewithin; and (c) at least one magnetic fastener comprising a first member attached to the inside of said pouch and a second member attached to the inside of said closure in position to releasably engage said first member when said closure is pivoted into close proximity to said pouch, wherein:

(d) said pouch is made from two pieces sewn together;

(e) said closure is an extension of one of said two pieces;

(f) said one of said two pieces comprises:

(i) an outer layer made of cloth;

(ii) an intermediate stiffening layer;

(iii) an intermediate padding layer; and (iv) an inner layer made of cloth; and (g) said intermediate stiffening layer is not contained in said closure.

2. An eyeglasses case or contact lens case cover as recited in claim 1 comprising three magnetic fasteners, each one of said three magnetic fasteners comprising a first member attached to the inside of said pouch and a second member attached to the inside of said closure in position to releasably engage the corresponding first member when said closure is pivoted into close proximity to said pouch.

3. An eyeglasses case or contact lens case cover as recited in claim 1 wherein said pouch and said closure are made from a soft, flexible cloth.

4. An eyeglasses case or contact lens case cover as recited in claim 1 wherein the edges of said pouch and said closure are encased in edging strips.

* * * * *